US007725958B1

(12) United States Patent
Gilmore

(10) Patent No.: US 7,725,958 B1
(45) Date of Patent: Jun. 1, 2010

(54) SHOULDER STRAP RETAINER

(76) Inventor: Margaret Gilmore, 65-23 79th St., Middle Village, NY (US) 11379

( * ) Notice: Subject to any disclaimer, the term of this patent is extended or adjusted under 35 U.S.C. 154(b) by 575 days.

(21) Appl. No.: 11/066,953

(22) Filed: Feb. 26, 2005

(51) Int. Cl.
*A41F 19/00* (2006.01)

(52) U.S. Cl. ..... 2/310

(58) Field of Classification Search ..... 2/459, 2/44, 45, 267, 268, 310, 326–328
See application file for complete search history.

(56) References Cited

U.S. PATENT DOCUMENTS

| | | | | | |
|---|---|---|---|---|---|
| 1,072,527 | A | | 5/1912 | Davis | |
| 1,544,303 | A | * | 6/1925 | Fellows | 24/341 |
| 2,004,305 | A | * | 6/1935 | Bopea | 24/305 |
| 2,476,712 | A | | 7/1949 | Eisenberg | |
| 2,932,869 | A | * | 4/1960 | Neubig | 24/354 |
| 3,710,391 | A | | 1/1973 | McGlynn | |
| 3,988,809 | A | * | 11/1976 | Powell et al. | 24/363 |
| 4,040,147 | A | | 8/1977 | King | |
| 4,051,554 | A | | 10/1977 | Kallman | |
| 4,168,544 | A | | 9/1979 | Kallman | |
| 4,811,876 | A | | 3/1989 | Riggi | |
| 5,441,188 | A | * | 8/1995 | Rosenstein | 224/264 |
| 5,692,239 | A | | 12/1997 | Lewis | |
| 5,992,176 | A | | 11/1999 | Arbogast | |
| 6,267,280 | B1 | * | 7/2001 | Silagy | 224/264 |
| 6,925,656 | B2 | * | 8/2005 | Henderson | 2/310 |

FOREIGN PATENT DOCUMENTS

| | | |
|---|---|---|
| GB | 10.782 | 5/1899 |
| GB | 215.182 | 5/1924 |
| GB | 657.059 | 9/1951 |
| GB | 140.319 | 3/2000 |

* cited by examiner

*Primary Examiner*—Tejash Patel
(74) *Attorney, Agent, or Firm*—Michael I Kroll

(57) ABSTRACT

Apparatus 10 discloses a shoulder strap retainer device providing means for selectively fastening a purse 26 or carryall strap to a user's shoulder 28. In one embodiment of the present invention 10, a pair of decorative jewelry-like articles 24 having means for attachment to an article of clothing 14 are fixed a selected distance apart providing means for easily inserting and removing a strap 12 therefrom while keeping the purse 26 or carryall strap from easily being displaced once placed therebetween. In another embodiment, the shoulder strap retainer is comprised of a housing having a transverse slot with opposing flanges 22 forming a cavity for the placement therein of a strap 12.

6 Claims, 13 Drawing Sheets

SHOULDER STRAP RETAINER

BACKGROUND OF THE INVENTION

1. Field of the Invention

The present invention relates generally to retaining devices and, more specifically, to a shoulder strap retainer device providing means for selectively fastening a purse or carryall strap to a user's shoulder.

In one embodiment of the present invention, a pair of decorative jewelry-like articles having means for attachment to an article of clothing are fixed a selected distance apart providing means for easily inserting and removing a strap therefrom while keeping the purse or carryall strap from easily being displaced once placed therebetween. This frees the user from having to hold onto or repetitiously reposition said strap enabled article, freeing the hands for other tasks.

In another embodiment, the shoulder strap retainer is comprised of a housing having a transverse slot with opposing flanges forming a cavity for the placement therein of a strap.

The present invention benefits people by freeing both hands when picking up children, packages or other items that may normally limit a person to the use of one hand. The device is not limited to women but may also be applied to children's garments.

2. Description of the Prior Art

There are other strap device designed for attachment thereto. Typical of these is U.S. Pat. No. 1,027,527 issued to Davis on May 28, 1912.

Another patent was issued to Eisenberg on Jul. 19, 1949 as U.S. Pat. No. 2,476,712. Yet another U.S. Pat. No. 4,040,147 was issued to Kallman on Oct. 4, 1977 and still yet another was issued on Mar. 14, 1989 to Riggi as U.S. Pat. No. 4,811,876.

Another patent was issued to Rosenstein on Aug. 15, 1995 as U.S. Pat. No. 5,441,188. Yet another U.S. Pat. No. 3,710,391 was issued to McGlynn on Jan. 16, 1973. Another was issued to Kallmam on Sep. 25, 1979 as U.S. Pat. No. 4,168,544 and still yet another was issued on Dec. 2, 1997 to Lewis as U.S. Pat. No. 5,692,239.

Another patent was issued to Arbogast on Nov. 30, 1999 as U.S. Pat. No. 5,992,176. Yet another U.K. Patent No. GB 1899 was issued to Lake on Jun. 24, 1899. Another was issued to O'Dell on Mar. 25, 1920 as U.K. Patent No. GB140,319. Another was issued on May 8, 1924 to Robinson as U.K. Patent No. GB215,182 and another was issued to White as U.K. Patent No. GB657,059.

U.S. Pat. No. 1,027,527

Inventor: Claude B. Davis

Issued: May 28, 1912

A clasp including an elongated base plate, a securing pin hinged at one end on the underneath face of said base plate, a sheave arranged transversely upon the top face of said base plate, an arched keeper hinged at one end on the top face of said base plate and extending longitudinally of said base said plate, and straddling said sheave, and a spring on said base plate normally holding said keeper closed.

U.S. Pat. No. 2,476,712

Inventor: Herman F. Eisenberg

Issued: Jul. 19, 1949

A shoulder strap for application to a garment for the purpose described, comprising a main member, an auxiliary member, means partially carried by one of said members and partially carried by the garment for attaching the shoulder strap to the latter, means partially carried by one of said members and partially carried by one of the auxiliary members and the garment for providing a previously located tunnel through which a supporting strap or the like may be extended, such tunnel being of less width than the length of the shoulder strap, said two means being so arranged and located relative to the length of the shoulder strap that strain along the length of the shoulder strap and delivered from said supporting strap laterally of the latter is at least substantially mainly absorbed by the second named means before reaching the first-named means.

U.S. Pat. No. 3,710,391

Inventor: Walter J. McGlynn

Issued: Jan. 16, 1973

A shoulder strap retainer consists of a weight distributing pad to be placed on the user's shoulder; a strap holding clip having a base plate riveted to the pad with a hold-down arm pivotally mounted to the base plate; and a cushion of soft, relatively frictional, material bonded to the' base plate so as to come between the base plate and the hold-down arm. The base plate is substantially flat, and the hold-down arm is curved to include an enlarged shoulder strap encompassing portion in adjacent relationship to the pivotal mounting of the hold-down arm to the base plate, and a strap contacting end portion in overlying relationship to the cushion. The encompassing portion of the arm and the pivotal mounting of the arm to the base plate prevents the shoulder strap from sliding downwardly off the user's shoulder and the strap contacting portion of the arm combined with the frictional cushion tends to prevent the shoulder strap from riding upwardly or downwardly from the retainer.

U.S. Pat. No. 4,040,147

Inventor: Marguerite King

Issued: Aug. 9, 1977

A shoulder strap retainer having a base to be positioned on the exterior shoulder portion of a garment with securing means attached to the undersurface of the base for removably securing the base to the exterior shoulder portion of the garment. A flexible cover is provided in a common overlapping plane for defining a pocket to contain the shoulder strap with locking means for retaining the flexible cover releasably secured to the base to retain the strap in the pocket. Releasing means is provided for disengagement of a catch associated with the locking means so that the strap is positionable into or out of the pocket.

U.S. Pat. No. 4,051,554

Inventor: Robert A. Kallman

Issued: Oct. 4, 1977

An accessory holder, for use on an article of clothing such as ski jacket or the like, comprising a flap having one end fixed to one attachment point on the article of clothing and adapted to fit around the accessory to be held, such as a pair of ski goggles. The other end of the flap is selectively fastened between another point of attachment on the article of clothing to hold the accessory, and still a further point of attachment where it is stored.

U.S. Pat. No. 4,168,544

Inventor: Robert A. Kallman

Issued: Sep. 25, 1979

An article-holding system in which a first piece having fabric fastening means thereon is adapted for attachment to a base member and a flap having a piece of complementary fabric fastening means on opposite faces at its ends is attached to said first piece at an intermediate point. The flap is folded at an intermediate point in a storage condition so that the pieces of complementary type fabric fastening material at its ends can be fastened to said first piece whereby a flap which is longer than the first piece can be stored to occupy only the length of the first piece. When in article holding use, the flap is extended from the first piece, bent around the article and fastened to the first piece. A dual type system is also provided where the article can be held in one of two locations.

U.S. Pat. No. 4,811,876

Inventor: Michael S. Riggi

Issued: Mar. 14, 1989

A retainer for positionally locating a shoulder strap of a handbag or the like relative to the shoulder of a user includes a base member carrying an adhesive for removably attaching the retainer to the skin on the shoulder of the user and a retainer member arranged to upstand from the base member and provide a recess for receiving the shoulder strap.

U.S. Pat. No. 5,441,188

Inventor: Julia A. Rosenstein

Issued: Aug. 15, 1995

A shoulder strap and jewelry retainer removeably attachable to a user's garment for support of ornamental jewelry attachments and for the retention of a shoulder strap so that a user may carry a sling or strap equipped article without lifting the shoulder while simultaneously preventing theft of the mentioned article. The shoulder strap and jewelry retainer may be attached to the user's garment by any conventional means and includes a releasable clip structure capable of capturing a shoulder strap. Ornamental jewelry is attached to the clip for disguising the clip structure and for accenting the user's clothing.

U.S. Pat. No. 5,692,239

Inventor: Donald G. Lewis

Issued: Dec. 2, 1997

A sleeve holder for securing a drawn-up sleeve of a garment is described. Also described is the sleeved garment into which the sleeve holder is incorporated. The sleeve holder has an epaulet strap which is secured to the shirt at the shoulder and projects down the sleeve. Cooperating connectors operate such that when the wearer pulls up the sleeve the connectors engage and hold the sleeve in the drawn-up position. When the wearer wants to return the sleeve to its fully extended normal position, the connectors are disengaged and the sleeve falls to its normal length. The connectors can be cooperating button and button hold, snap elements or, preferably, hook-and-loop fabric strips, especially when oriented at right angles to each other. Use of the sleeve holder prevents a sleeve from interfering with the wearer's activities or becoming soiled or entangled during those activities.

U.S. Pat. No. 5,992,176

Inventor: Gina M. R. Arbogast

Issued: Nov. 30, 1999

A jewelry item having a top member pivotally joined by a hinge to a lower base member used to retain a handbag's shoulder strap in place to the clothing of a user. The top and base members are curved lengthwise to resemble the natural curvature of a user's shoulder. A latch on the top can engage a mating member on the base member to lock the top and base members together when closed. A fastener on the base can attach the jewelry item to the clothing of a user at their shoulder. Several different designs and materials are disclosed for the exposed upper surface of the top member to exhibit and resemble a fine piece of jewelry. This jewelry item may be worn along or used to retain the shoulder strap of a handbag to a user.

U.K. Patent Number GB1899

Inventor: Henry Harris Lake

Issued: Jun. 24, 1899

The invention discloses improvements in shirt-bosom-retaining devices comprising a pair of tabs respectively connected with the opposite side edges of the bosom, and each tab containing wholly within itself a side way for one of the trousers-supporting straps, substantially as described.

U.K. Patent Number GB140,319

Inventor: Albert Edward O'Dell

Issued: Mar. 25, 1920

The length of the sleeve of a shirt or other garment is adjusted by means of a flap C adapted to be secured to buttons G, H, I, preferably carried by a strip of fabric extending from the shoulder seam B to the cuff A. A number of such adjusting-devices, and other fastening-means than buttons, may be used.

U.K. Patent Number GB215,182

Inventor: John Alwyn White

Issued: Sep. 12, 1951

A shirt is provided with a reversible half front B, FIGS. 1 and 6, which can be reversed about a vertical line from the position shown so as to engage buttons b<1> on the other side. The half front B is provided with a double central strap A which is provided with pairs of buttonholes b<2>, b<3> and is stitched centrally to the shirt. The reversible half front may be made of different materials on its two faces to match corresponding materials on the shirt. A band b is preferably provided to fit under the collar of the wearer.

U.K. Patent Number GB657,059

Inventor: John Alwyn White

Issued: Sep. 12, 1951

In a shirt of the kind which is combined with trouser suspension means, such means comprise a pair of substantially triangular yoke pieces a, b made from the same material as the shirt and sewn together at c to form divergent strap portions d and having attached thereto a rear strap h. The yokes are secured to the in side of the shirt by sewing thereto beneath the collar band at f and across the shoulders at s. The straps are formed into loops of adjustable length by means of buttons and holes p, q or other fastening means and support on the inside of the shirt brace tabs 1 which pass out through reinforced slots m.

While these straps may be suitable for the purposes for which they were designed, they would not be as suitable for the purposes of the present invention, as hereinafter described.

SUMMARY OF THE PRESENT INVENTION

The present invention discloses a shoulder strap retainer device providing means for selectively fastening a purse or carryall strap to a user's shoulder. In one embodiment of the present invention, a pair of decorative jewelry-like articles having means for attachment to an article of clothing are fixed a selected distance apart providing means for easily inserting and removing a strap therefrom while keeping the purse or carryall strap from easily being displaced once placed therebetween. In another embodiment, the shoulder strap retainer is comprised of a housing having a transverse slot with opposing flanges forming a cavity for the placement therein of a strap.

A primary object of the present invention is to provide means for holding the shoulder placement of a strap for a purse or carryall.

Another object of the present invention is to provide an article having means for retaining a strap.

Yet another object of the present invention is to provide a strap retaining article having a slot for the placement therein of a strap.

Still yet another object of the present invention is to provide a strap retaining article having at least one flanges for retaining a strap.

Another object of the present invention is to provide a strap retaining article having decorative elements incorporated therein.

Additional objects of the present invention will appear as the description proceeds.

The present invention overcomes the shortcomings of the prior art by providing a shoulder strap retainer device providing means for selectively fastening a purse or carryall strap to a user's shoulder. The shoulder strap retainer is comprised of a housing having a transverse slot with opposing flanges forming a cavity for the placement therein of a strap.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
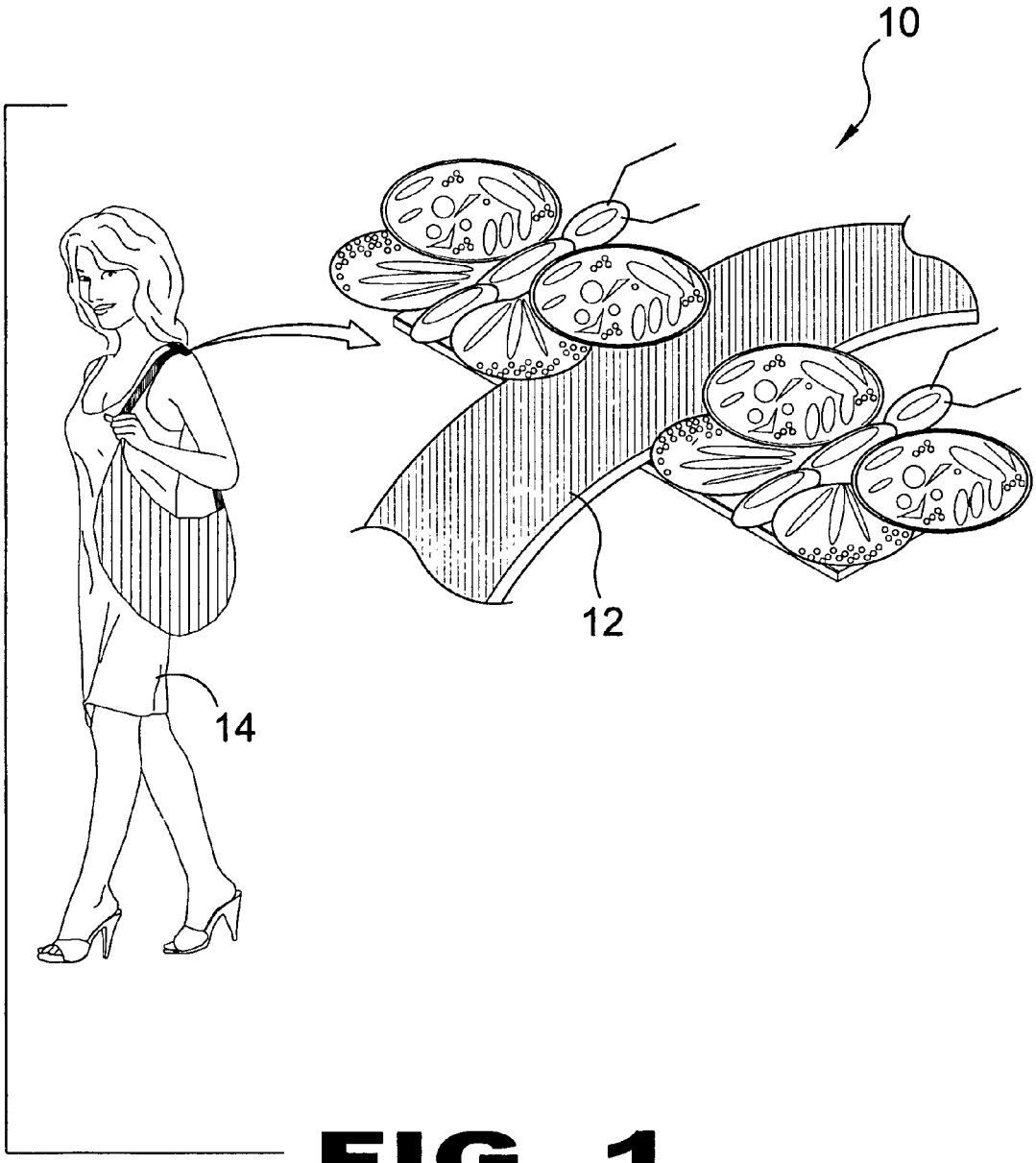
FIG. 1 is an illustrative view of the present invention in use.

With regard to reference numerals used, the following numbering is used throughout the drawings.

10 present invention
12 strap
14 garment
16 base
18 decorative element
20 snaps
22 recess and restraining bracket
24 ornaments

26 purse
28 shoulder
30 stitches
32 scooped out portion
34 packaging
36 buttons
38 pins

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention in use. The present invention 10 discloses a shoulder strap retainer having a base with top portion having a recess and retaining elements for receiving and securing a shoulder strap 12, the shoulder strap retainer to be positioned on the exterior shoulder portion of a garment 14 with securing means to the exterior of a garment. The top portion of the shoulder strap retainer also having decorative snap-on retaining elements.

Figure 2:
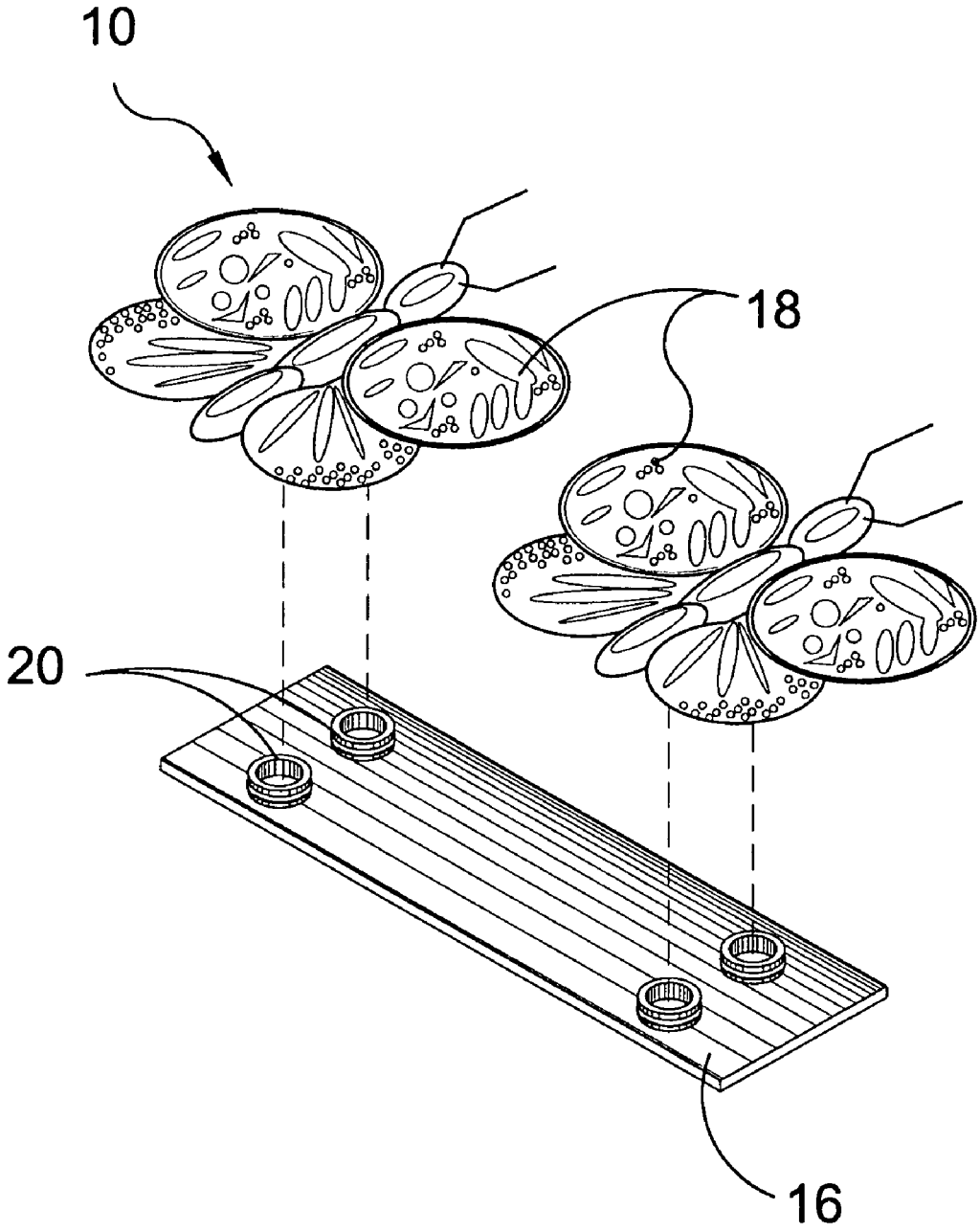
FIG. 2 is an illustrative view of the present invention in use.

Turning to FIG. 2, shown therein is an illustrative view of the present invention in use. Shown is an illustrative view of the present invention 10 disclosing a shoulder strap retainer having a base 16 with snaps 20 with top portion having decorative snap-on elements 18 for receiving and securing a shoulder strap, the shoulder strap retainer to be positioned on the exterior shoulder portion of a garment with securing means to the exterior of a garment. The top portion of the shoulder strap retainer also having decorative snap-on elements 18 or ornaments. The device 10 is designed to secure a strap of a purse or pocket book to the shoulder.

Figure 3:
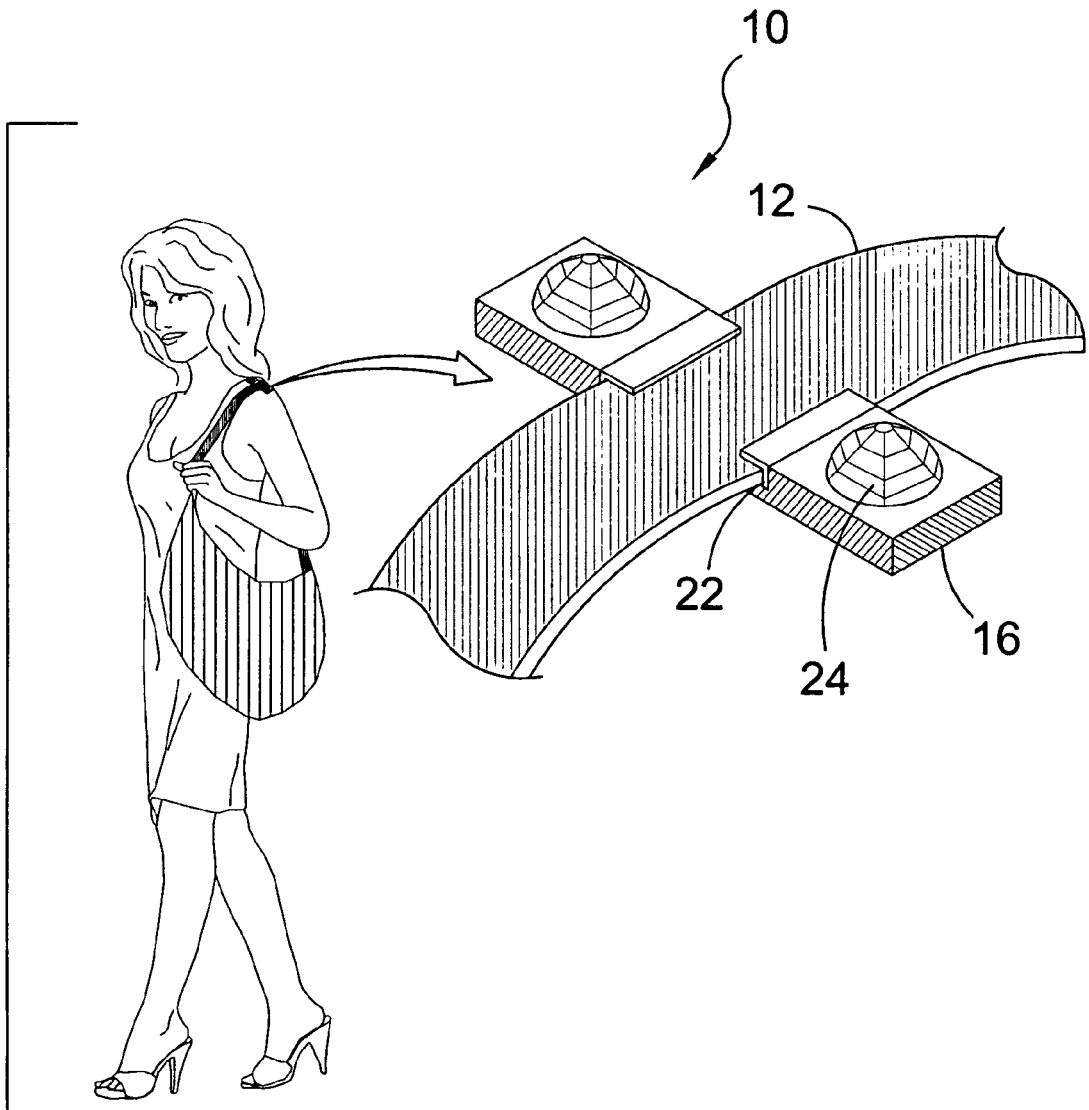
FIG. 3 is a perspective view of the present invention.

Turning to FIG. 3, shown therein is a perspective view of the present invention. Shown is a perspective view of the present invention 10 disclosing a shoulder strap retainer having a base 16 with top portion having a recess 22 and retaining bracket for receiving and securing a shoulder strap 12, the shoulder strap retainer to be positioned on the exterior shoulder portion of a garment with securing means to the exterior of a garment. The top portion of the shoulder strap retainer also having decorative gems or ornaments 24. Base 16 is perpendicular to the strap 12.

Figure 4:
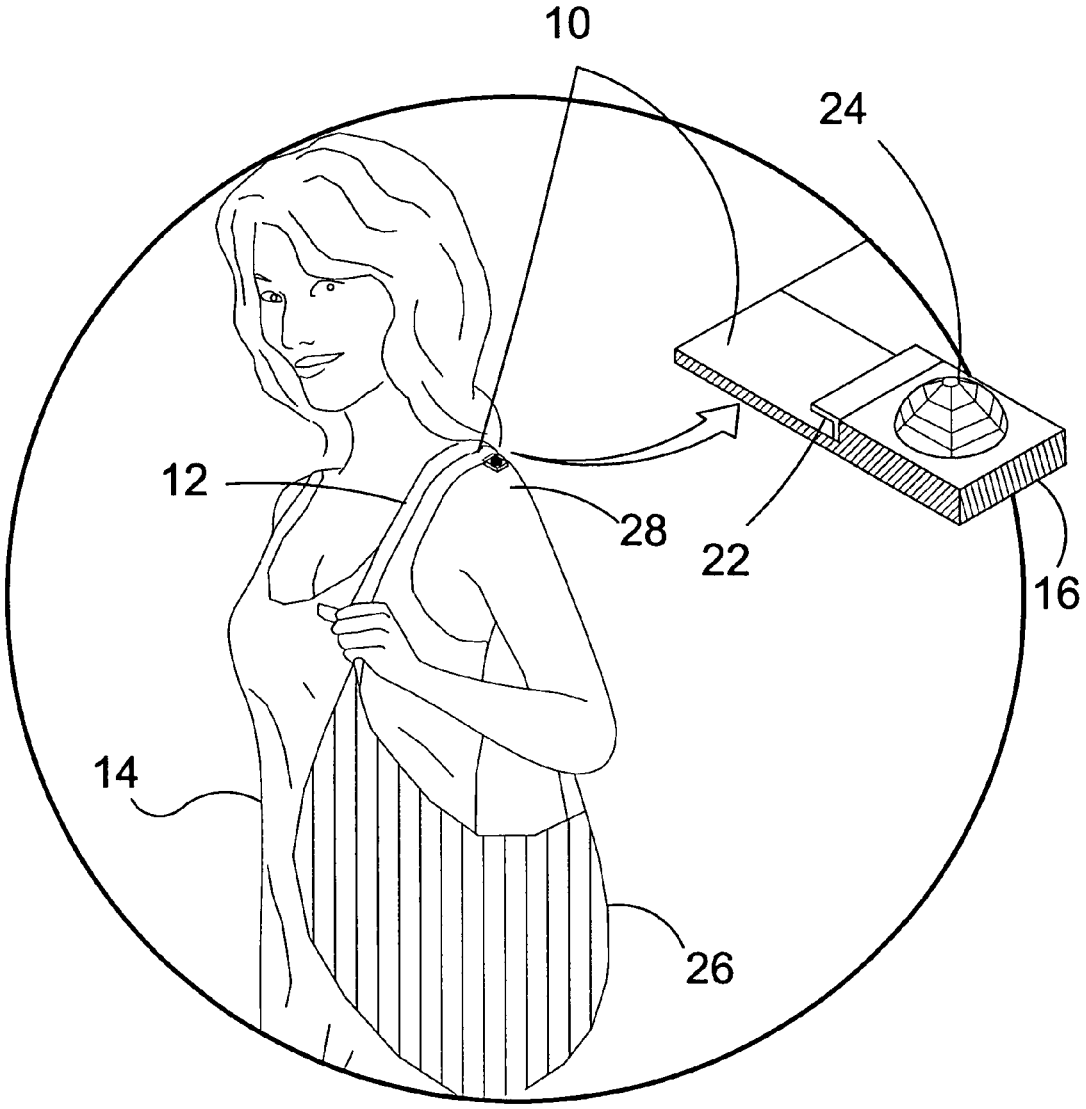
FIG. 4 is an illustrative view of the present invention in use.

Turning to FIG. 4, shown therein is an illustrative view of the present invention in use. Shown is an illustrative view of the present invention 10 disclosing a shoulder strap retainer having a base 16 with top portion having a recess and retaining bracket 22 for receiving and securing a shoulder strap, the shoulder strap retainer to be positioned on the exterior shoulder portion of a garment 14 with securing means to the exterior of a garment. The top portion of the shoulder strap retainer also having decorative gems or ornaments 24. The device 10 is designed to secure a strap 12 of a purse 26 or pocketbook to the shoulder 28 of a user. Shown is the present invention's 10 retaining bracket 22 only being of one piece depicting the capability of the present invention being utilized by only one such element.

Figure 5:
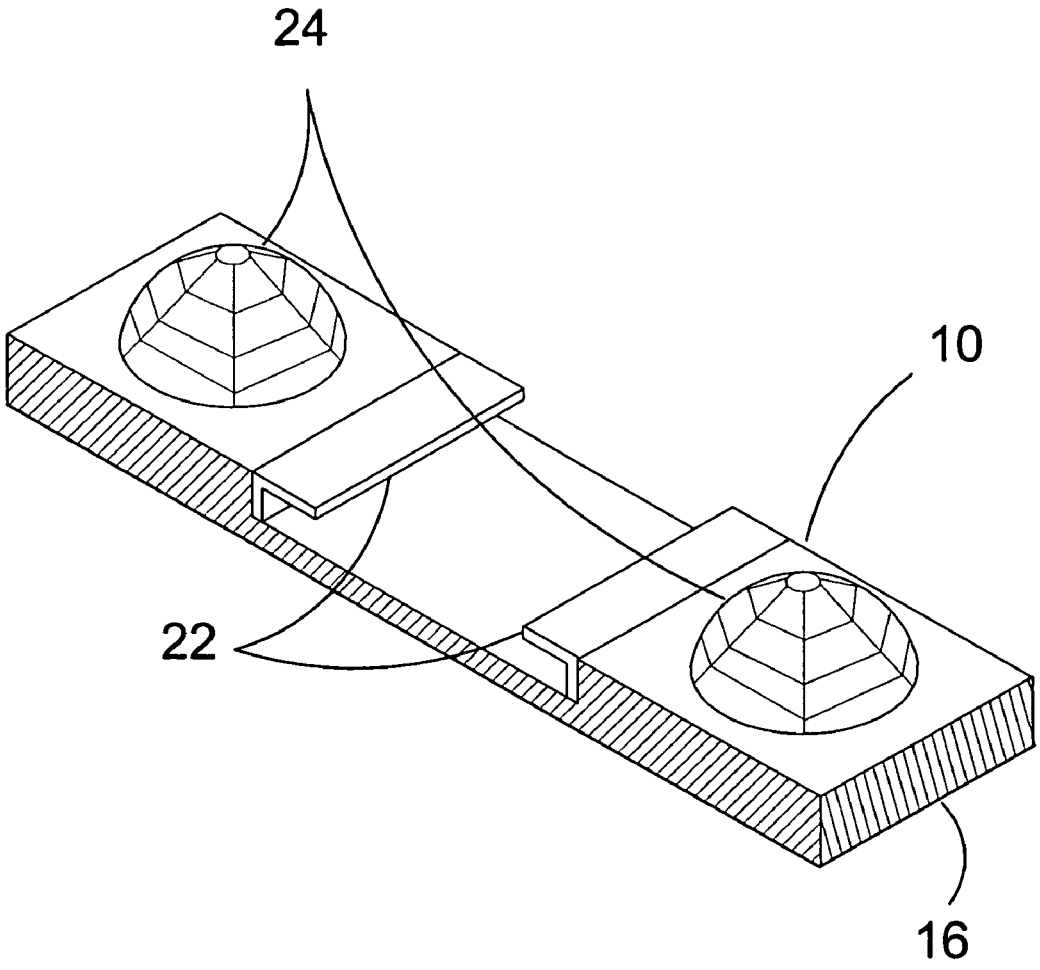
FIG. 5 is a perspective view of the present invention.

Turning to FIG. 5, shown therein is a perspective view of the present invention. Shown is a perspective view of the present invention 10 disclosing a shoulder strap retainer having a base 16 with top portion having a recess and retaining bracket 22 for receiving and securing a shoulder strap, the shoulder strap retainer to be positioned on the exterior shoulder portion of a garment. The top portion of the shoulder strap retainer also having decorative gems or ornaments 24.

Figure 6:
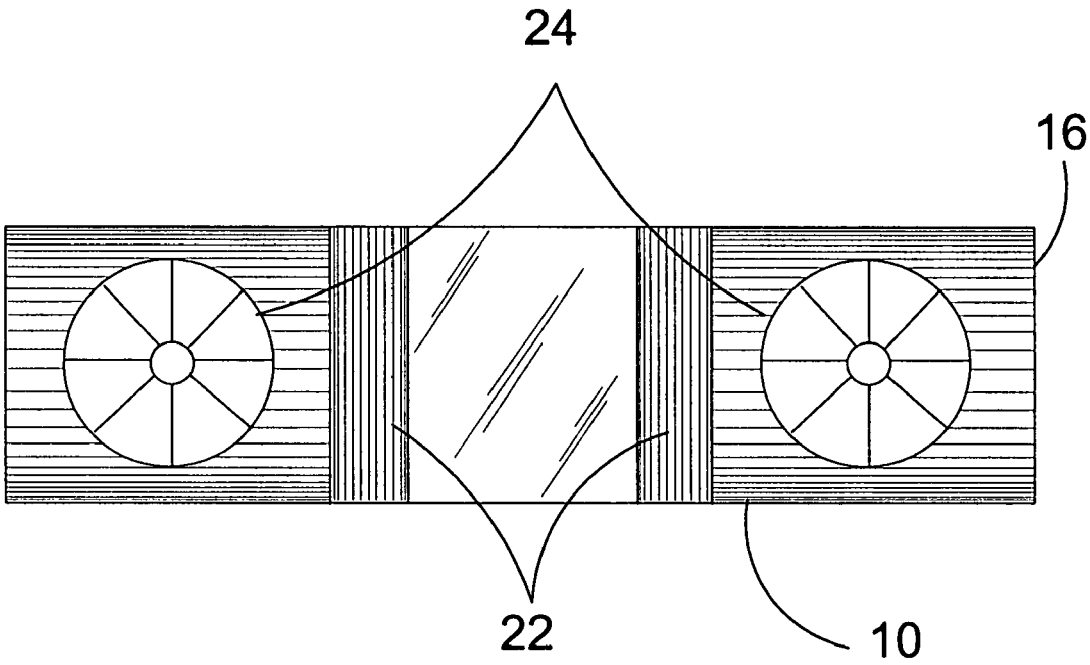
FIG. 6 is a top view of the present invention.

Turning to FIG. 6, shown therein is a top view of the present invention. Shown is a perspective view of the present invention 10 disclosing a shoulder strap retainer having a base 16 with top portion having a recess and retaining bracket 22 for receiving and securing a shoulder strap, the shoulder strap retainer to be positioned on the exterior shoulder portion of a garment. The top portion of the shoulder strap retainer also having decorative gems or ornaments 24.

Figure 7:
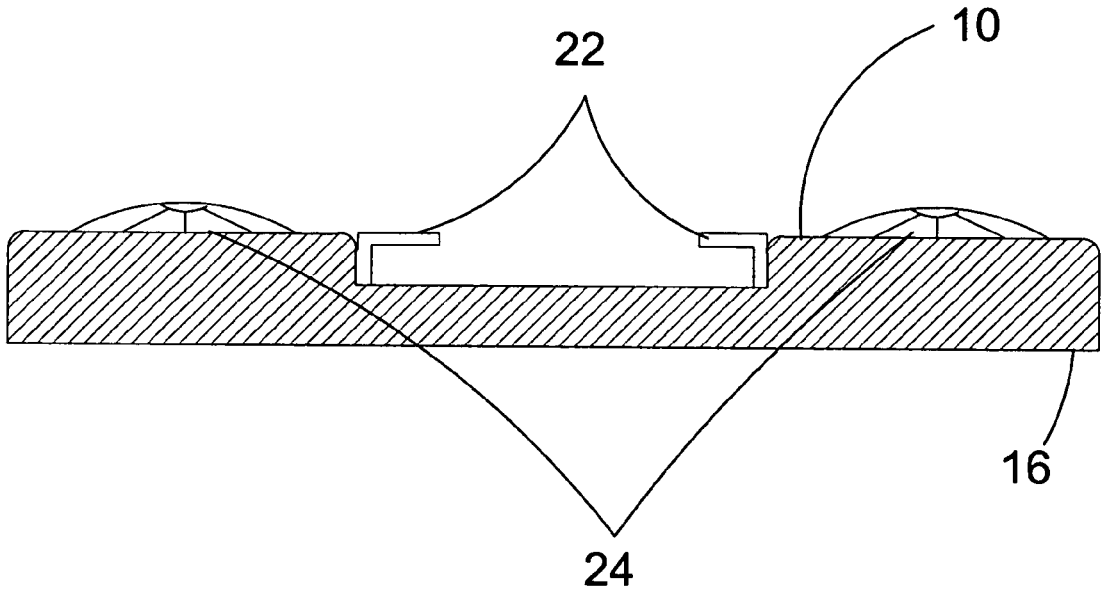
FIG. 7 is a side view of the present invention.

Turning to FIG. 7, shown therein is a side view of the present invention. Shown is a side view of the present invention 10 disclosing a shoulder strap retainer having a base 16 with top portion having a recess and retaining bracket 22 for receiving and securing a shoulder strap, the shoulder strap retainer to be positioned on the exterior shoulder portion of a garment with securing means to the exterior of a garment. The top portion of the shoulder strap retainer also having decorative gems or ornaments 24.

Figure 8:
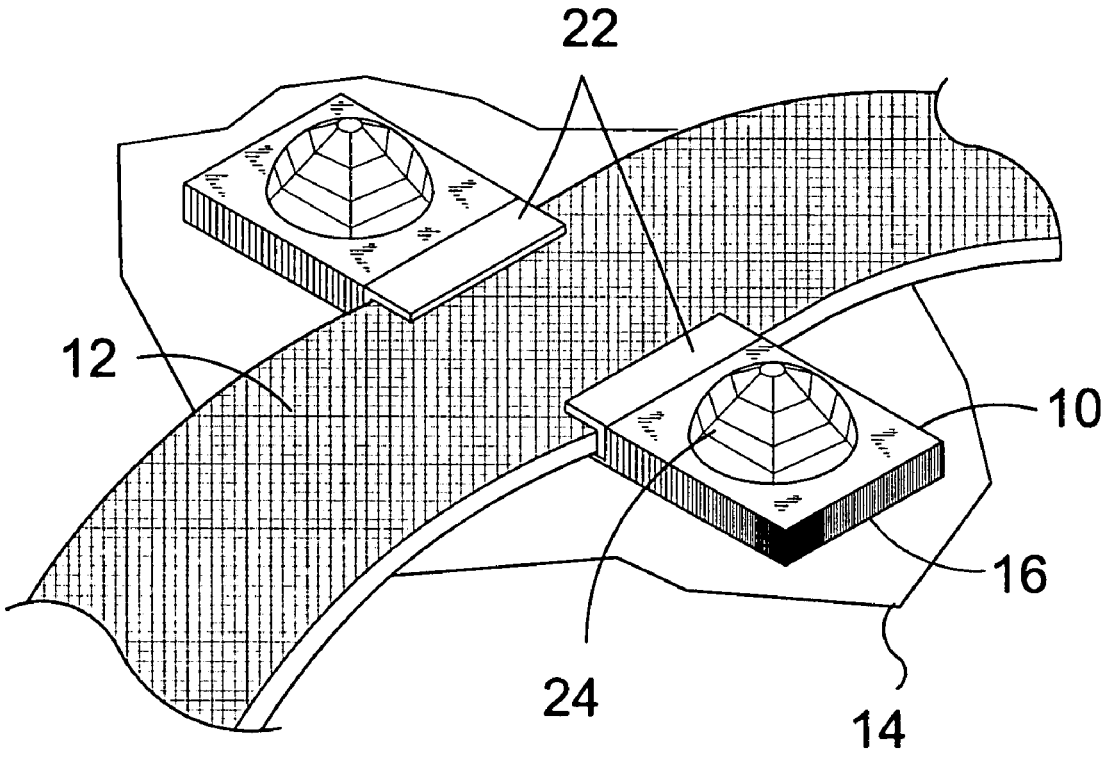
FIG. 8 is a perspective view of the present invention attached to a garment with strap positioned within the recess of the retainer.

Turning to FIG. 8, shown therein is a perspective view of the present invention 10 attached to a garment 14 with a strap 12 positioned within the recess of the retainer 22. Shown is a perspective view of the present invention 10 disclosing a shoulder strap retainer having a base 16 with top portion having a recess and retaining bracket 22 for receiving and securing a shoulder strap 12, the shoulder strap retainer to be positioned on the exterior shoulder portion of a garment 14 with securing means to the exterior of a garment. The top portion of the shoulder strap retainer also having decorative gems or ornaments 24.

Figure 9:
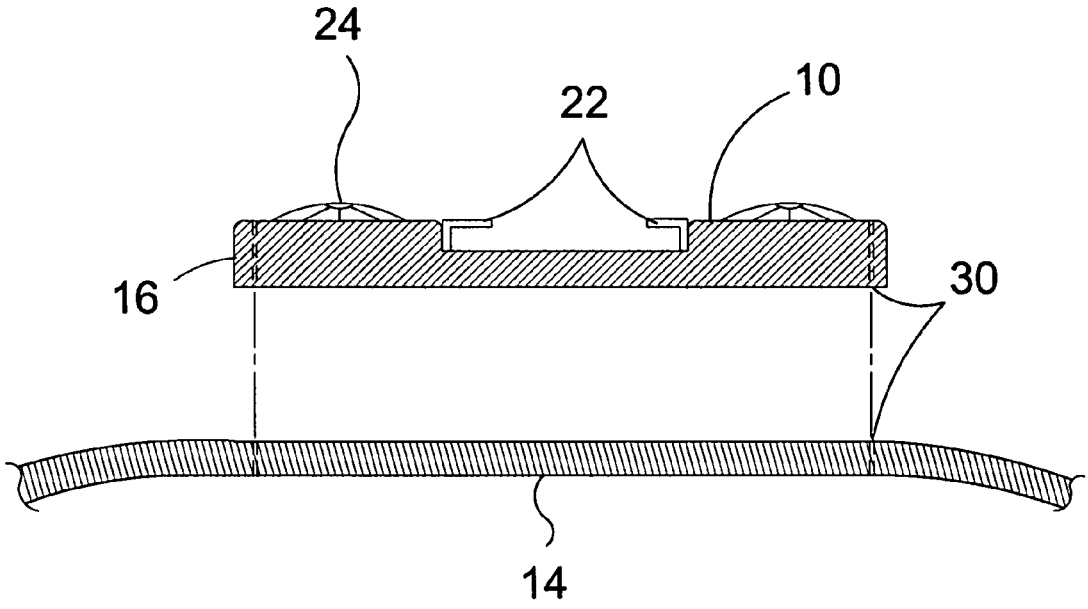
FIG. 9 is an exploded sectional view of the present invention.

Turning to FIG. 9, shown therein is an exploded sectional view of the present invention. Shown is a sectional view of the present invention 10 disclosing a shoulder strap retainer having a base 16 with top portion having a recess and retaining bracket 22 for receiving and securing a shoulder strap, the shoulder strap retainer to be positioned on the exterior shoulder portion of a garment 14 with securing means to the exterior of a garment. The top portion of the shoulder strap retainer also having decorative gems or ornaments 24. Also shown is the base 16 sewn with stitches at 30 to garment 14.

Figure 10:
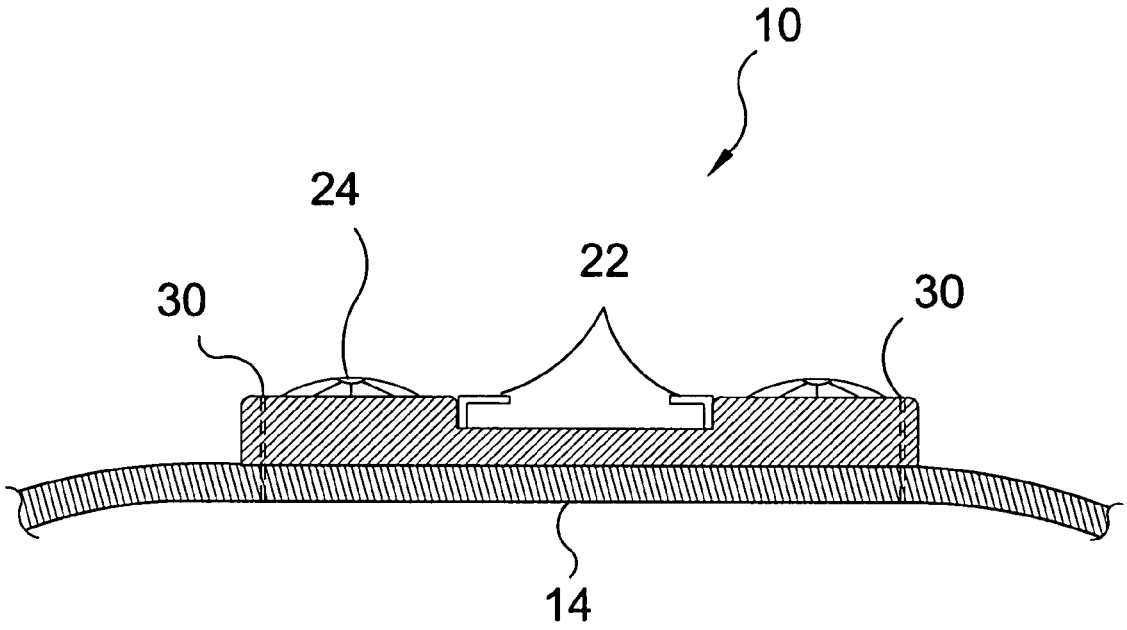
FIG. 10 is a sectional view of the present invention mounted to the shoulder portion of a garment.

Turning to FIG. 10, shown therein is a sectional view of the present invention mounted to the shoulder portion of a garment. Shown is a sectional view of the present invention 10 disclosing a shoulder strap retainer having a base with top portion having a recess and retaining bracket 22 for receiving and securing a shoulder strap, the shoulder strap retainer 22 to be positioned on the exterior shoulder portion of a garment 14 with securing means such as being sewn at 30 to the exterior of a garment. The top portion of the shoulder strap retainer also having decorative gems or ornaments 24.

Figure 11:
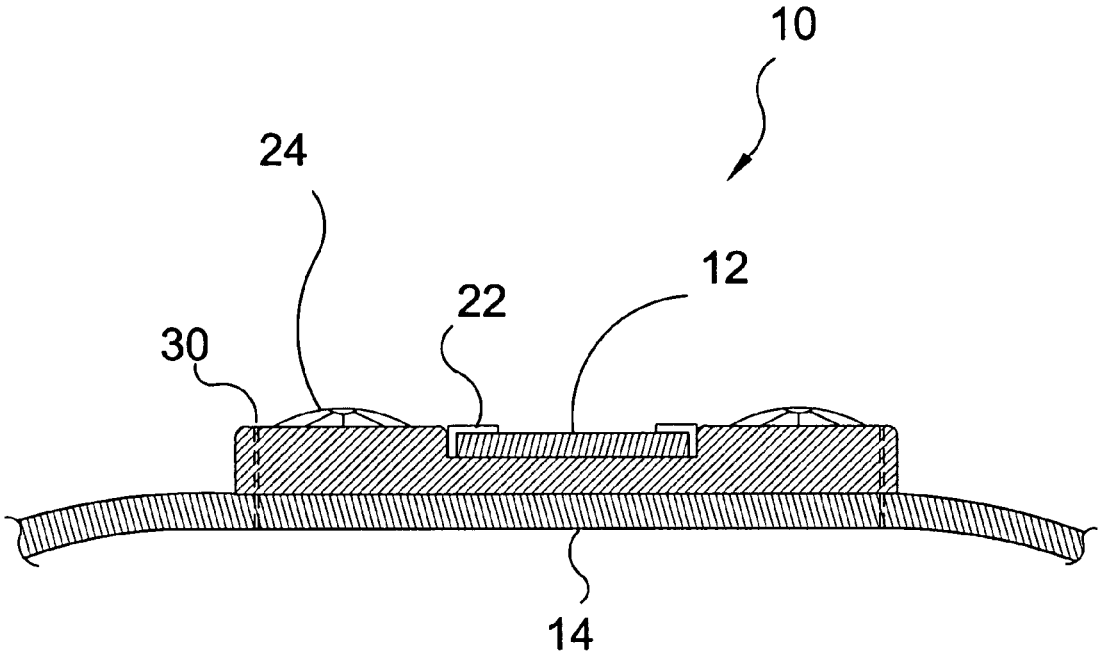
FIG. 11 is a sectional view of the present invention mounted to the shoulder portion of a garment having a strap secured within the retainer.

Turning to FIG. 11, shown therein is a sectional view of the present invention 10 mounted to the shoulder portion of a garment 14 having a strap 12 secured within the retainer 22. Shown is a sectional view of the present invention 10 disclosing a shoulder strap retainer having a base with top portion having a recess and retaining bracket 22 for receiving and securing a shoulder strap 12, the shoulder strap retainer to be positioned on the exterior shoulder portion of a garment 14 with securing means such as sewing 30 to the exterior of a garment. The top portion of the shoulder strap retainer also having decorative gems or ornaments 24.

Figure 12:
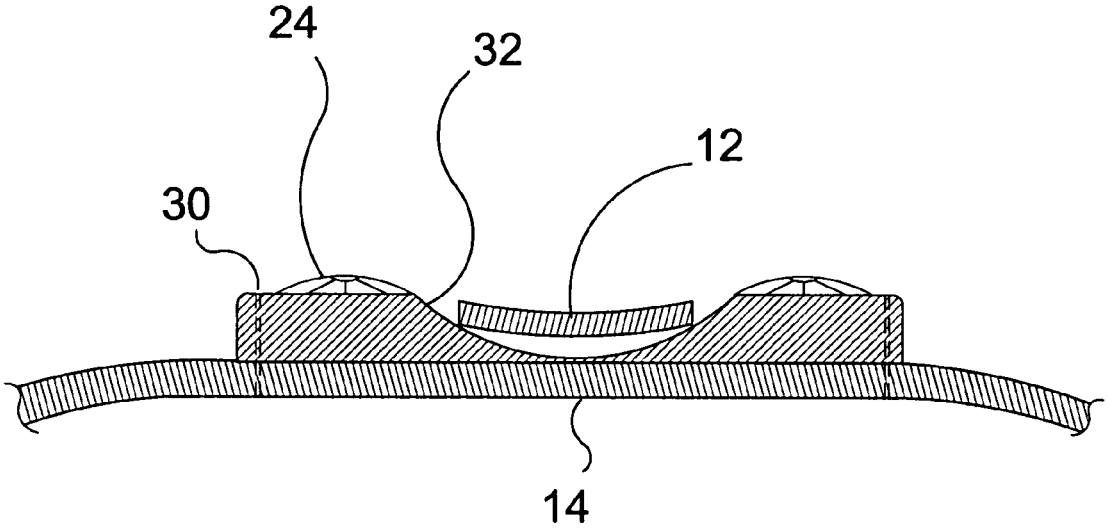
FIG. 12 is a sectional view of the present invention mounted to the shoulder portion of a garment having a strap secured within a scooped out portion.

Turning to FIG. 12, shown therein is a sectional view of the present invention mounted to the shoulder portion of a garment having a strap secured within a scooped out portion. Shown is a sectional view of the present invention 10 disclosing a shoulder strap retainer having a base with top portion having a scooped out portion 32 to hold a shoulder strap 12 the shoulder strap retainer to be positioned on the exterior shoulder portion of a garment 14 with securing means such as sewing 30 to the exterior of a garment. The top portion of the shoulder strap retainer also having decorative gems or ornaments 24.

Figure 13:
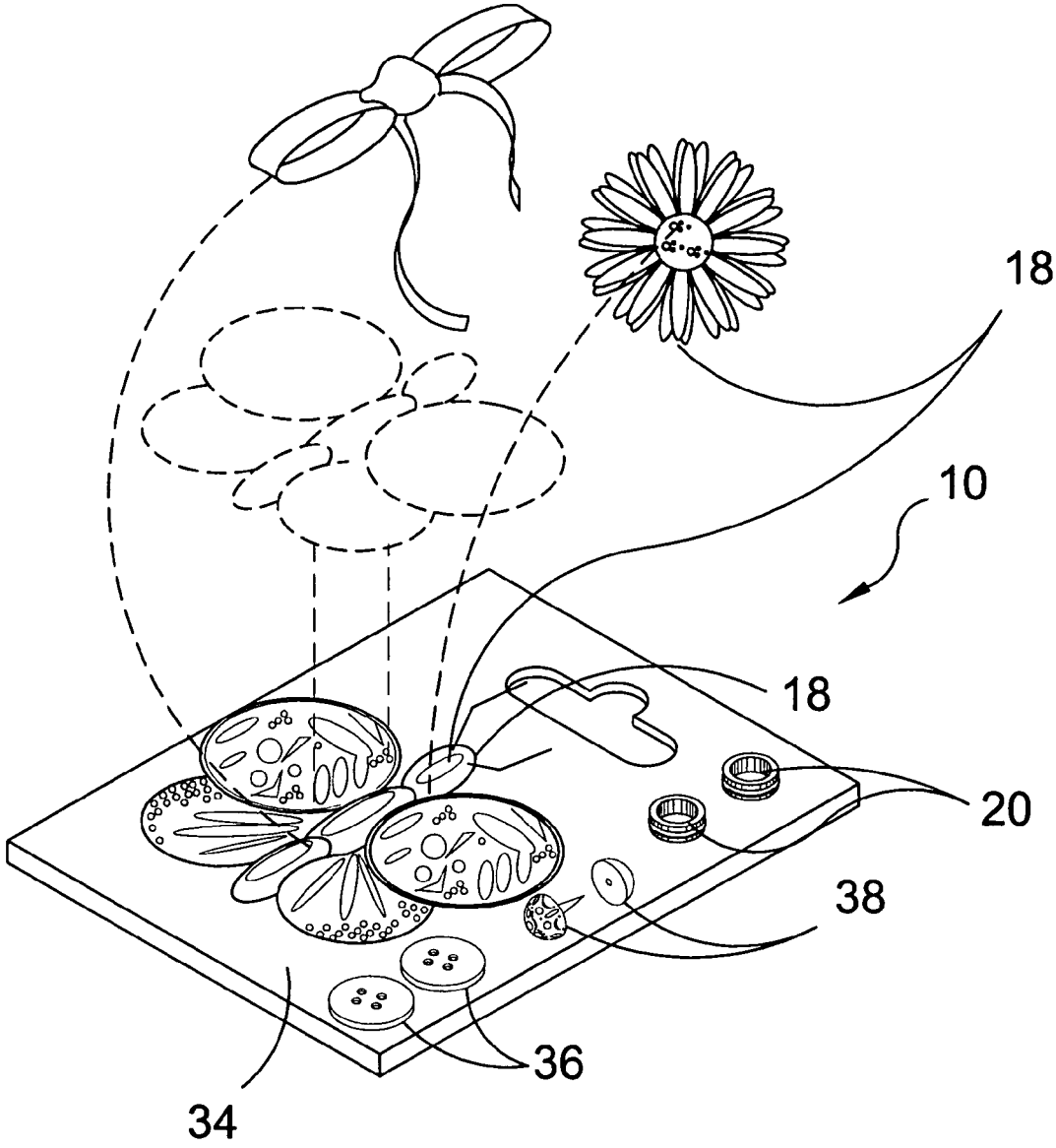
FIG. 13 is an illustrative view of the present invention in use.

Turning to FIG. 13, shown therein is an illustrative view of the present invention in use. Shown is an illustrative view of the present invention 10 depicting how the present invention may be sold in packages 34 consisting of strap holding elements with varying aesthetic appeal while also including different types of clothing fastening members such as buttons 36, pins 38 and snaps 20. Also shown are decorative elements 18.

I claim:

1. A shoulder strap retainer for attaching a shoulder strap of a purse to the shoulder portion of an outer garment, comprising:

a) an elongated single piece base having first and second distal ends, and top and bottom flat surfaces on an exterior shoulder portion of said garment, an elongated axis of said base being aligned with a length of said shoulder extending between a sleeve of said garment and an opening for a neck of a user;

b) first and second ornamental members being disposed on said top surface of said base, wherein one ornamental member is disposed adjacent each of said first and second distal ends of said base so that said ornamental members are aligned with said elongated axis;

c) means substantially centrally located between said first and second distal ends of said base for retaining said shoulder strap on said top surface of said base between said ornamental members; and, d) said bottom surface of said base attached to a top, outer side of said exterior shoulder portion of the garment worn by a user whereby said purse is secured to the shoulder of said user and said ornamental members are visible on an outside of said outer garment to other persons.

2. The retainer of claim 1, wherein said base is disposed substantially perpendicular to the shoulder strap.

3. The retainer of claim 1, wherein said retaining means comprises:

a) said base having a recess therein, said recess disposed in said top surface of said base, wherein the shoulder strap rests in said recess; and, b) oppositely opposed flanges disposed on each side of said recess so that each flange partially overlaps said recess and said shoulder strap so that the shoulder strap is retained in said recess by said flanges.

4. The retainer of claim 3, wherein said flanges are L-shaped members mounted in opposite sides of said recess.

5. The retainer of claim 2, wherein said means for retaining said shoulder strap on said base comprises a concave shaped recess in said top surface of said base for cradling said strap.

6. The combination of an outer garment, a purse and a shoulder strap retainer for attaching said purse to the outside of a shoulder portion of said garment, comprising:

a) an elongated single piece base having first and second distal ends, and top and bottom surfaces attached to an exterior shoulder portion of said garment and an elongated axis of said base being aligned with a length of said shoulder extending between a sleeve of said garment and an opening for a neck of a user;

b) ornamental members mounted on said top surface of said base adjacent said distal ends of said base;

c) a recess formed in said top surface of said base substantially centrally located between said ornamental members;

d) said recess bordered by L-shaped members mounted in opposite ends of said recess forming facing flanges overlapping said strap in said recess for retaining said shoulder strap in said recess, said shoulder strap being at a right angle to the elongated axis of said base; and e) whereby said purse is secured to said shoulder of said user and said ornamental members are visible to other persons.

* * * * *